United States Patent [19]

Herring, Jr.

[11] 4,428,302

[45] Jan. 31, 1984

[54] EMERGENCY SPRING SYSTEM FOR A RAILWAY CAR

[75] Inventor: James M. Herring, Jr., Merion Station, Pa.

[73] Assignee: The Budd Company, Troy, Mich.

[21] Appl. No.: 347,495

[22] Filed: Feb. 10, 1982

[51] Int. Cl.[3] ..... B61F 5/06

[52] U.S. Cl. ..... 105/197 R; 267/22 R; 267/64.11

[58] Field of Search ..... 105/197 B, 197 R; 267/34, 64.11, 3, 4, 168, 169, 61 R, 22 R

[56] References Cited

U.S. PATENT DOCUMENTS

| | | | |
|---|---|---|---|
| 1,303,816 | 5/1919 | Fuller | 267/61 R |
| 1,853,933 | 4/1932 | Schmidt | 267/4 |
| 3,313,245 | 4/1967 | Sundby | 105/197 R |
| 3,343,830 | 9/1967 | Dean et al. | 105/197 B |

FOREIGN PATENT DOCUMENTS

| | | | |
|---|---|---|---|
| 362724 | 9/1971 | U.S.S.R. | 267/3 |

*Primary Examiner*—Robert B. Reeves
*Attorney, Agent, or Firm*—Edward M. Farrell; Herman Foster; Thomas I. Davenport

[57] ABSTRACT

Emergency springs are disposed within air springs which are used for normally supporting a railway car body. When the air springs fail, the car body is supported by the emergency springs. Each of the emergency springs includes a conventional spring in combination with a pair of angularly disposed springs which changes operating chracteristics when the load is increased.

3 Claims, 8 Drawing Figures

FIG. 1
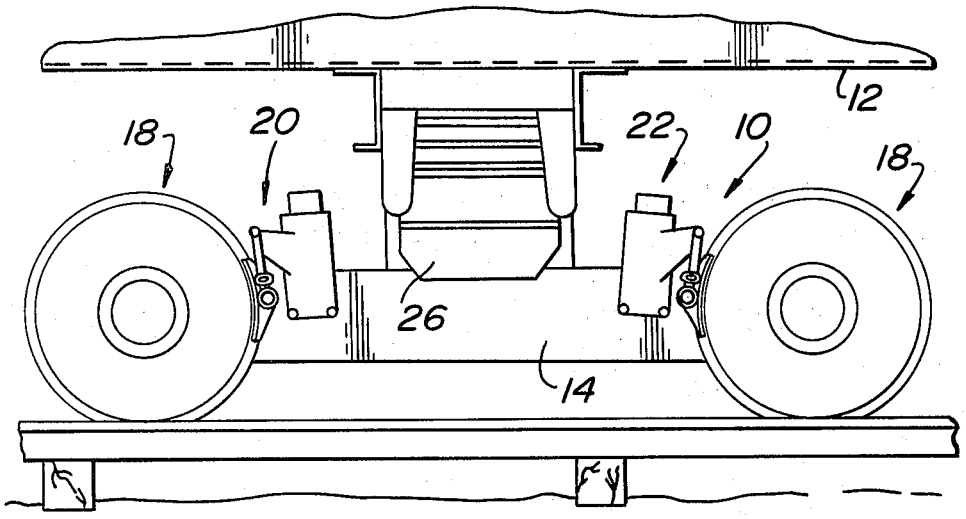
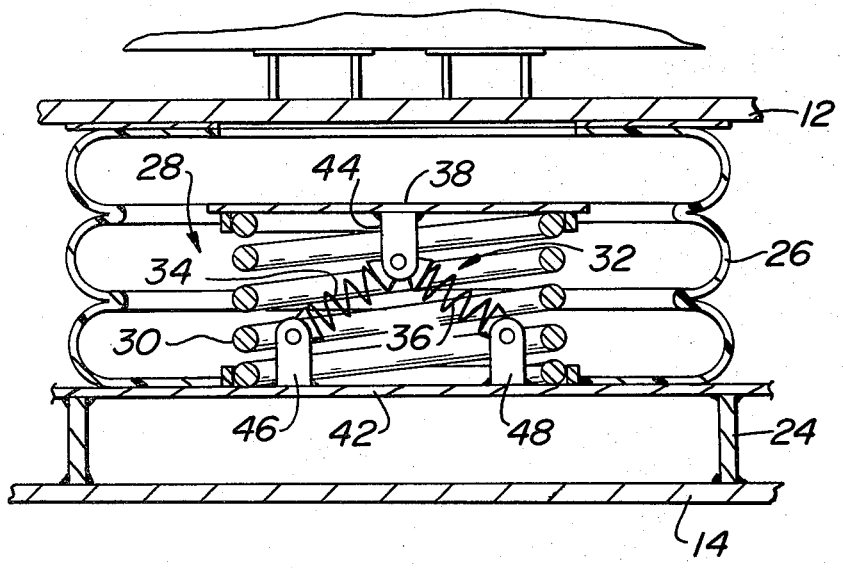
FIG. 2

FIG. 3
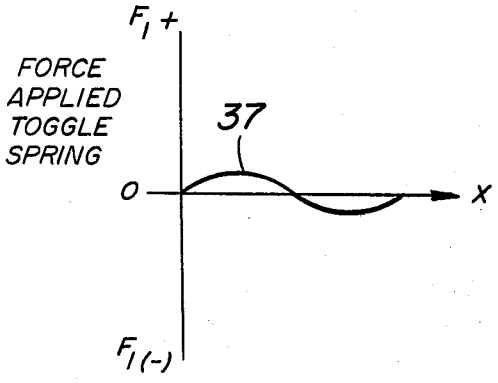
FIG. 3a
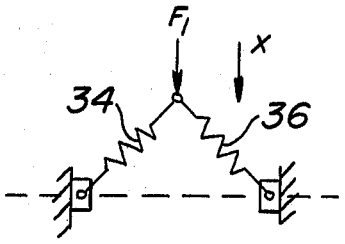
FIG. 4
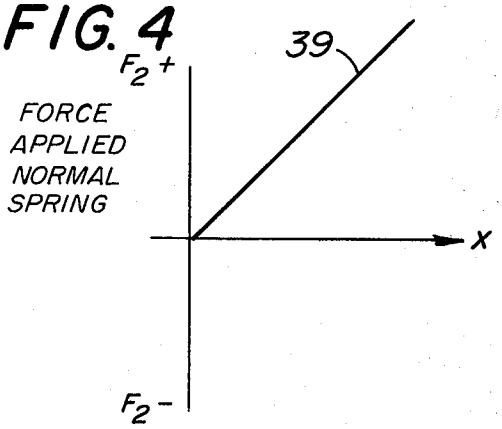
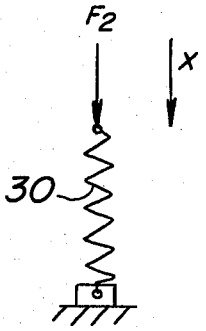
FIG. 4a
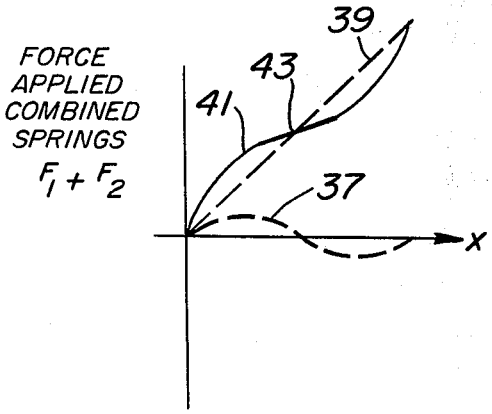
FIG. 5
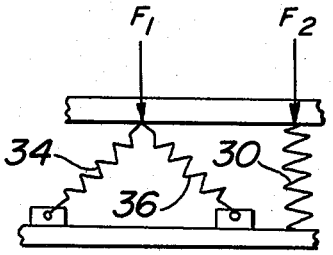
FIG. 5a

EMERGENCY SPRING SYSTEM FOR A RAILWAY CAR

BACKGROUND OF THE INVENTION

Air spring suspensions on railcars have been used for many years. Among the reasons for this is that air springs provide a better vertical ride and are quieter than other types of suspension systems involving mechanical springs and parts.

One of the problems related to air springs is that they may lose air and collapse. Rubber blocks are sometimes installed inside the air bags at some specified distance under the car body to serve to support the car body when the air springs fail. However, the vertical spring rate of the rubber block is normally too high to limit the total deflection of the system, that at high speeds the vibration of the car becomes intolerable. Other types of emergency springs have been used in case of air spring failure, but generally the use of such emergency springs have involved either an uncomfortable ride for the passengers in the car or have required that the car be moved at a relatively low speed.

OBJECTS OF THE INVENTION

It is an object of this invention to provide an improved emergency spring arrangement.

It is still a further object of this invention to provide an improved emergency spring system in which the ride quality is maintained at a reasonable level at relatively high car speeds when the associated air springs fail, and at the same time limit the vertical motion of the car body when the main air spring fails.

BRIEF SUMMARY OF THE INVENTION

In accordance with the present invention, emergency springs are disposed within a pair of air springs which are used to support the car body. Each of the emergency springs include a conventional spring in combination with a pair of angularly disposed springs. In the event that the air springs fail, the car body is supported by the emergency springs. A relatively smooth ride is provided by the emergency springs and the vertical displacement of the car body is limited as a result of a high spring rate up to the weight of the car, a low spring rate in the range of loading, and a high spring rate above maximum loading. This is achieved by combining the spring characteristics of the conventional spring with the actions and characteristics of the pair of angularly disposed springs connected at one end to a common element. With these characteristics, the linear operating portion of the spring combination may be selected for a predetermined load to assure a comfortable ride.

BRIEF DESCRIPTION OF THE DRAWINGS

FIG. 1 is a side view of a typical truck for supporting a railway car with a suspension system of the type involved in the present invention;

FIG. 2 is a cross-sectional view taken along lines 2—2 of FIG. 1;

FIG. 3 is a curve illustrating the response characteristic to car loading of a typical angularly disposed spring arrangement, in accordance with the present invention;

FIG. 3*a* is a typical toggle spring arrangement which may be used in the present invention;

FIG. 4 is a curve illustrating the response characteristic to car loading of a typical conventional spring which may be used with the toggle spring arrangement illustrated in FIG. 3*a;*

FIG. 4*a* illustrates a typical conventional spring which has the response characteristic illustrated in FIG. 4;

FIG. 5 is a series of curves in which a different combined response characteristic of the springs of FIGS. 3*a* and 4*a* are combined; and FIG. 5*a* is a view illustrating the springs of FIGS. 3*a* and 4*a* in combination.

DETAILED DESCRIPTION OF THE INVENTION

Referring particularly to FIG. 1, a typical truck assembly 10 is disposed to support a railway car body 12. The truck 10 includes a pair of conventional side frames, such as the side frame 14. Wheel-axle units 18 and 20 are connected to the side frames 14. Suitable braking devices 20 and 22 are secured to the side frames in close proximity to the wheels of the wheel-axle units. All of these various elements are well known to those skilled in the art.

Referring to FIG. 2, along with FIG. 1, a bolster 24 is connected to the side frames 14. Spring mounting blocks, not illustrated, may be disposed toward the ends of the bolster 24 to receive the spring arrangements. A pair of air spring units, of which only one 26 is illustrated, are secured to the ends of the bolster 24 between the bolster 24 and the car body 12. Emergency spring units, of which only one 28 is illustrated, which specifically involve the present invention, are disposed within the air springs.

The air springs, such as the air spring 26, are generally inflated with air under pressure and are used to provide vertical suspension means for the rail car body. Such springs are conventional and will not be described further. However, in the event of failure of air pressure in the car, and consequently the air springs, the emergency springs towards which the present invention is directed become operative.

Referring to FIG. 2, the emergency spring 28 is disposed within the air spring 26 to support the car body 12 in the event that the air supplying the spring 26 fails. When the air spring 26 fails, the car body 12 will rest on the emergency spring arrangement 28. The emergency spring 28, as will be described, is designed so that the car 12 may continue to be moved at a reasonably fast speed while still providing a comfortable ride for the passengers.

The spring arrangement 28 comprises a spring 30 with a toggle spring 32 therein. The spring 30, illustrated as a mechanical spring may sometimes be an air spring. The spring 30 may be a spring which exhibits a linear compression rate when a varying load is placed thereon.

The spring arrangement 32 comprises a pair of mechanical springs 34 and 36 having conventional spring properties during expansion and contraction. A top mounting plate 38 is clear from the car floor when the air spring is inflated. The top of the spring 30 is secured by any suitable means to the plate 38. The bottom of the spring 30 is secured to the seating plate 42 of the bolster 24.

Attachment member 44 is secured to the plate 38 and attachment members 46 and 48 are secured to the seat 42. The mechanical spring 34 is pivotally connected through suitable end connecting elements, such as the pivot pins illustrated between the attachment members 44 and 46, with the mechanical spring 36 being pivotally connected through suitable end connecting elements, such as the pivot pins illustrated, between the attachment members 44 and 48. The angularly disposed springs 34 and 36 both have one end pivotally connected to the attachment member 44.

When the load presented by the car body 12 is below a certain loading, a high spring rate is provided to limit the vertical deflection of the car body by the combined spring characteristics of the spring 30 and the spring arrangement 32. This is because both the spring 30 and the spring arrangement 32 to provide resistance to the loading of the car body.

When the loading of the car exceeds a certain level, the car body 12 moved downward against the resistance of the spring 30 and the resistances of the mechanical springs 34 and 36. The lowering of the car body eventually causes the springs 34 and 36 to be directed downwardly, in effect removing the resistance of the springs 34 and 36. Thus a low spring rate is provided in a range of car loading, with the low spring rate being caused by the action of the springs 34 and 36.

If the load of the car is above the normal maximum load, the car body 12 continues to move downwardly. The springs 34 and 36 being directed at downward angles, again offer spring resistance to the car loading. The combined effect of the resistance of the spring 30 and the springs 34 and 36 is to provide a high spring rate above the maximum load of the car body. The initial high spring rate, an intermediate low spring rate and a final high spring rate are desirable properties for an emergency spring arrangement, when the main air springs fail. Further, when the overall combined spring loading characteristics of the springs are determined and the car loading is known, the system may be designed so that the normal loading takes place over a low spring rate portion of the operating spring compression characteristic thereby assuring passengers a comfortable ride.

To assist in the understanding of the operation of the combined spring 30 and the spring arrangement 32, each of the springs and their respective characteristics will be considered separately prior to considering their combined effect.

Referring to FIGS. 3 and 3*a*, the resistance of the springs 34 and 36 produced as the car body 12 moves downwardly is indicated by $F_1$. X represents the loading of the car body 12. The resistance offered by the springs 34 and 36 is illustrated by a curve 37 having an essentially sinusoidal characteristic. This is because initially the springs 34 and 36 are being compressed to offer more resistance until an optimum resistance is reached. The resistance then decreases as the springs 34 and 36 tend to become parallel with the floor of the car body. The resistance reaches zero when the springs 34 and 36 change directions to point downwardly. The resistance then gradually increases and decreases again as indicated by the curve 37 in FIG. 3.

Referring to FIGS. 4 and 4*a*, the curve 39 relating to the spring 30 is essentially linear indicating that the resistance $F_2$ of the spring 30 increases linearly as the car body moves downward in accordance with the distance X. Many conventional mechanical and air springs may be designed to exhibit the characteristic of the curve 39 illustrated in FIG. 4 with the slope of the characteristic curve being determined by the spring design.

It is recognized that the curves 37 and 39 illustrated in FIGS. 3 and 4, respectively, are idealized curves for purposes of explanation. The springs employed may be designed to exhibit different resistance characteristics dependent upon the combined spring resistance characteristic design which is determined by the operating conditions of the car involved. In general, it is desirable to combine a conventional spring with a spring arrangement wherein the combined result is a spring resistance wherein the car body will operate in a linear operating portion so as to provide maximum riding comfort for passengers during emergency conditions after the air springs have failed. This condition will be illustrated in connection with FIGS. 5 and 5*a*.

FIG. 5 illustrates the curve 37 relating to the spring resistance of the springs 34 and 36. The linear curve 39 represents the spring resistance of the spring 30. A curve 41 represents the combined spring resistance of the spring 30 and the springs 34 and 36. A portion 43 of the curve 41 involves a low spring rate operating range. It is desirable that the spring resistance have this linear characteristic over a range of normal loadings of the car body 12. This is a range in which passenger comfort is assured during the time that the emergency spring is operative as the car continues to move at reasonable speeds.

It is apparent that different cars will operate at different loads. To accomplish a particular load, the spring resistances of either the conventional springs or the spring arrangement 32, or both, would have to be designed accordingly in order to achieve the proper spring rate operating range for emergency operating range of the combined springs. The different designs may involve heavier or larger springs, for example. Also, the particular angles or lengths of the springs 34 and 36 may be varied to achieve different overall results.

The present invention makes it possible to design an emergency spring system in which relatively conventional and ready commercially available spring members may be used. At the same time, the methods of installation and use of the springs follow normal techniques.

What is claimed is:

1. In combination with an air spring for supporting a rail car on a bolster of a truck, an emergency spring system disposed within said air spring to support said rail car when said air spring fails comprising:

(a) a first spring having a relatively linear spring rate;

(b) a pair of angularly disposed mechanical springs each having one end pivotally connected to a common member with their opposite ends being pivotally connected to said bolster having a relatively sinusoidal spring resistance to an increasing load produced by said rail car body; and (c) said spring and said pair of angularly disposed mechanical springs being connected in parallel with respect to each other to produce a combined spring resistance including a low spring rate operating range for a range of different loads produced by said rail car body without high vertical car body deflection.

2. A combination as set forth in claim 1 wherein said first spring is connected between said rail car body and said bolster and said pair of mechanical springs are disposed within said first spring.

3. A combination as set forth in claim 2 wherein said first spring comprises a mechanical spring.

* * * * *